US008445061B2

(12) United States Patent
McGuffey

(10) Patent No.: US 8,445,061 B2
(45) Date of Patent: May 21, 2013

(54) METERING SYSTEM FOR HOT MELT ADHESIVES WITH VARIABLE ADHESIVE VOLUMES

(75) Inventor: Grant McGuffey, Springfield, TN (US)

(73) Assignee: Illinois Tool Works Inc., Glenview, IL (US)

( * ) Notice: Subject to any disclaimer, the term of this patent is extended or adjusted under 35 U.S.C. 154(b) by 377 days.

(21) Appl. No.: 12/711,203

(22) Filed: Feb. 23, 2010

(65) Prior Publication Data

US 2011/0014430 A1 Jan. 20, 2011

Related U.S. Application Data

(63) Continuation-in-part of application No. 12/458,620, filed on Jul. 17, 2009.

(51) Int. Cl.
*B05D 5/10* (2006.01)

(52) U.S. Cl.
USPC ..... 427/207.1; 427/208.2; 427/208.4; 427/208.6; 222/61; 222/137; 222/276; 118/202; 118/203; 118/300

(58) Field of Classification Search ..... 427/207.1, 427/208.2, 208.4, 208.6; 222/61, 137, 276; 118/202, 118/203, 300
See application file for complete search history.

(56) References Cited

U.S. PATENT DOCUMENTS

| | | | | |
|---|---|---|---|---|
| 6,296,463 | B1 | 10/2001 | Allen | |
| 6,422,428 | B1 | 7/2002 | Allen et al. | |
| 6,840,404 | B1 * | 1/2005 | Schultz et al. | 222/61 |
| 6,936,125 | B2 | 8/2005 | Harris | |
| 7,014,911 | B2 | 3/2006 | Harris | |
| 2001/0000611 | A1 | 5/2001 | Cline et al. | |
| 2002/0138064 | A1 * | 9/2002 | Datta et al. | 604/391 |
| 2004/0159672 | A1 | 8/2004 | Auber et al. | |
| 2005/0228114 | A1 * | 10/2005 | Gelles | 524/502 |
| 2007/0133489 | A1 * | 6/2007 | Ramesh et al. | 370/338 |
| 2008/0302299 | A1 | 12/2008 | Lessley et al. | |

FOREIGN PATENT DOCUMENTS

| | | | |
|---|---|---|---|
| EP | 0112638 | A2 | 7/1984 |
| EP | 1421997 | A1 | 5/2004 |
| FR | 2878911 | A1 | 12/2004 |
| JP | 10008705 | A | 1/1998 |

* cited by examiner

*Primary Examiner* — Nathan Empie
*Assistant Examiner* — Xiao Zhao
(74) *Attorney, Agent, or Firm* — Levenfeld Pearlstein, LLC

(57) ABSTRACT

A method of making an article having a substrate and a material applied thereto includes providing a metered fluid dispensing system having a supply of fluid to be dispensed, an output device having at least one dispensing nozzle, at least two pumps for pumping fluid from the supply to the at least one dispensing nozzle. The pumps are in close proximity to the dispensing nozzle. Output supply passageways interconnect the pumps and the dispensing nozzle, and flow control elements selectively control the passage of the fluid from the pumps to the nozzle. The substrate is conveyed past the fluid dispensing system in a machine direction and fluid is applied to the substrate in a plurality of segments. Each segment has a volume per unit length and is applied in a length in the machine direction to define a pattern. The pattern includes at least some areas in which the fluid is present at a first volume as applied from one of the pumps and at least some areas in which fluid is present at a second volume that is greater than the first volume, as applied from both of the pumps.

15 Claims, 6 Drawing Sheets

METERING SYSTEM FOR HOT MELT ADHESIVES WITH VARIABLE ADHESIVE VOLUMES

CROSS-REFERENCE TO RELATED APPLICATION DATA

This application is a continuation-in-part and claims the benefit of U.S. patent application Ser. No. 12/458,620, filed Jul. 17, 2009

FIELD OF THE INVENTION

The present invention relates generally to hot melt or other thermoplastic material dispensing systems, and more particularly to a new and improved hot melt adhesive or other thermoplastic material dispensing system which comprises the utilization of two separate and independent rotary, gear-type metering pumps, or two separate and independent sets of rotary, gear-type metering pumps, which are adapted to output or discharge precisely metered amounts of hot melt adhesive or other thermoplastic material. In particular, the precisely metered amounts of the hot melt adhesive or other thermoplastic material discharged from the two separate and independent rotary gear pumps, or from the two separate and independent sets of rotary gear pumps, are able to in fact be independently discharged or outputted through suitable output devices or applicators onto a particular substrate so as to result in different discharged or outputted volumes of the hot melt adhesive material or other thermoplastic material onto the substrate in accordance with predeterminedly required or desired patterns, or at predeterminedly required or desired locations. Still further, the precisely metered amounts of the hot melt adhesive or other thermoplastic material from the two separate and independent rotary gear pumps, or from the two separate and independent sets of rotary gear pumps, may also have their volumetric outputs effectively combined such that the discharged or outputted volumes of the hot melt adhesive or other thermoplastic material onto the substrate may effectively be, for example, twice the discharged or output-ted volumes of the hot melt adhesive or other thermoplastic material discharged or outputted onto the substrate from only one of the two separate and independent rotary gear pumps, or from only one of the two separate and independent sets of rotary gear pumps.

BACKGROUND OF THE INVENTION

In some conventional liquid metering systems, such as, for example, those outputting or discharging hot melt adhesives or other thermoplastic materials, it is usually the practice to output or discharge a predetermined volumetric constant of the particular material. The outputted or discharged materials are pumped through a pump manifold, by means of, for example, suitable metering pumps, to one or more outlets with which suitable output devices or applicators are operatively and fluidically connected so as to deposit the materials onto a suitable substrate in accordance with any one of several predetermined patterns. Such conventional metering systems normally comprise a motor to drive the pumps at variable rates of speed in order to achieve the desired output volumes from the pumps in order to in fact achieve the desired depositions of the materials onto the substrates. Accordingly, the speed of the motor drive, and the result drive of the metering pumps, can be altered depending upon, for ex-ample, the speed of the substrate being processed, that is, for example, the speed of the substrate as the same passes by the output devices or applicators. Depending upon the structure or configuration of the particular substrate or product onto which the hot melt adhesive or other thermoplastic material is being deposited, it is desirable to be able to quickly change the volumetric output of the hot melt adhesive or other thermoplastic material at predetermined times of the material application process, that is, the system must be readily capable of increasing or decreasing the outputted or discharged volumes of the material. While some systems can achieve these changes in the outputted or discharged volumes of material by altering the speed of the pump drive motor, in product process systems, where hot melt adhesive or other thermoplastic materials are being applied to different substrates or products, the product processing speeds, characteristic of hot melt adhesive or other thermoplastic material dispensing metering systems, prevent the change in the speed of the pump motor drive from viably achieving such outputted or discharged volume changes in the hot melt adhesive or other thermoplastic materials as required or desired.

A need therefore exists in the art for a new and improved liquid metering system which is readily capable of rapidly achieving the aforenoted changes in volumetric out-puts of the metering pumps so as to, in turn, achieve the required or desired changes in the outputted or discharged volumes of hot melt adhesive or other thermoplastic material to be deposited onto a substrate or product at predetermined times and/or locations during a product processing run or operation.

SUMMARY OF THE INVENTION

The foregoing and other objectives are achieved in accordance with the teachings and principles of the present invention through the provision of a new and improved hot melt adhesive or other thermoplastic material dispensing sys-tem which comprises the utilization of two separate and independent rotary, gear-type metering pumps, or two separate and independent sets of rotary, gear-type metering pumps, which are adapted to output or discharge precisely metered amounts of hot melt adhesive or other thermoplastic material. In particular, the precisely metered amounts of the hot melt adhesive or other thermoplastic material discharged from the two separate and independent rotary gear pumps, or from the two separate and independent sets of rotary gear pumps, are able to in fact be independently discharged or outputted through suitable output devices or applicators onto a particular substrate so as to result in different discharged or outputted volumes of the hot melt adhesive material or other thermoplastic material onto the substrate in accordance with predeterminedly required or desired patterns, or at predeterminedly required or desired locations. Still further, the precisely metered amounts of the hot melt adhesive or other thermoplastic material from the two separate and independent rotary gear pumps, or from the two separate and independent sets of rotary gear pumps, may also have their volumetric outputs effectively combined such that the discharged or outputted volumes of the hot melt adhesive or other thermoplastic material onto the substrate may effectively be, for example, twice the discharged or outputted volumes of the hot melt adhesive or other thermoplastic material discharged or outputted onto the substrate from only one of the two separate and independent rotary gear pumps, or from only one of the two separate and independent sets of rotary gear pumps.

Methods using the present applicator system and an article made thereby are also disclosed.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
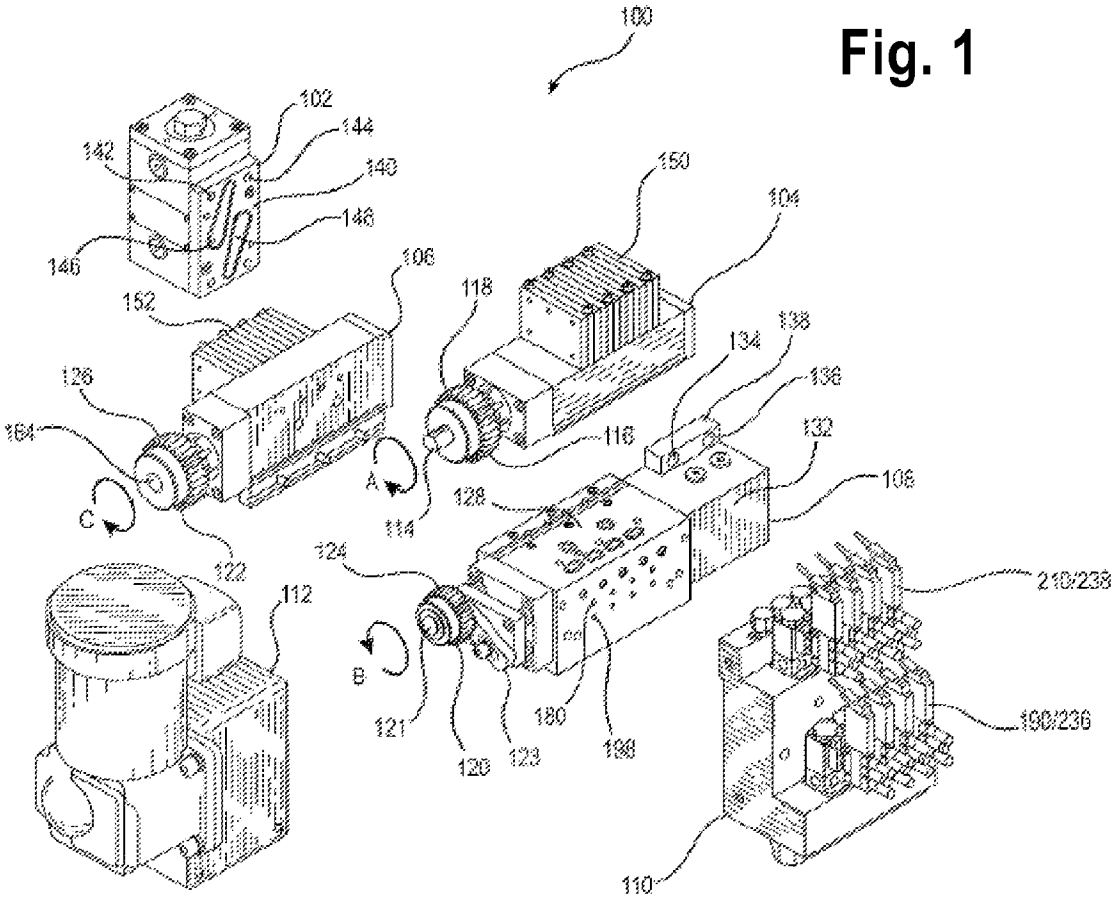
FIG. 1 is an exploded view of a first embodiment of a new and improved metering system for hot melt adhesive or other thermoplastic materials, and for achieving variable output volumes thereof, as constructed in accordance with the principles and teachings of the present invention, wherein the outputted, discharged, or dispensed volumes of the hot melt adhesive or other thermoplastic material can be varied as required or desired.
Figure 2:
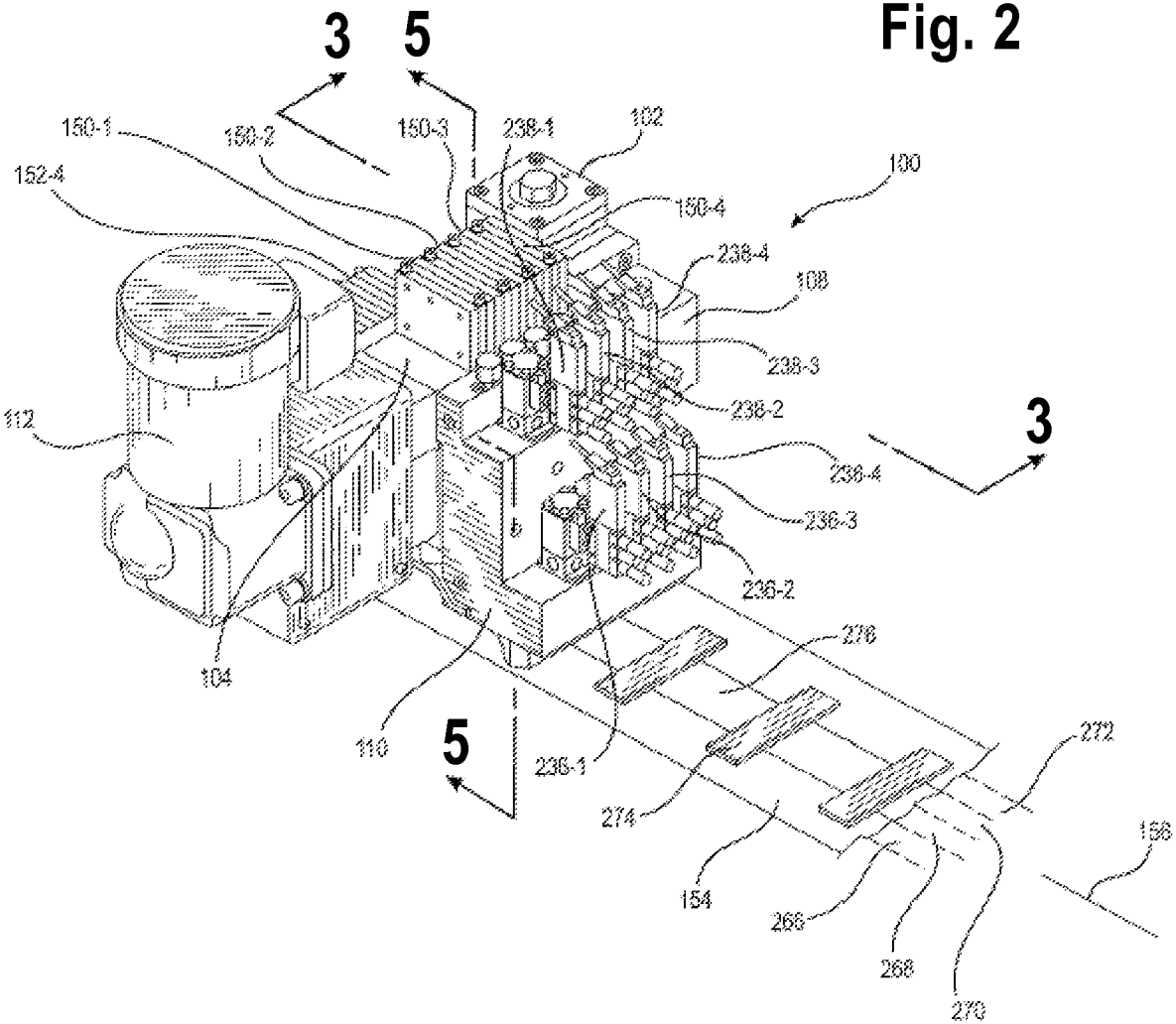
FIG. 2 is an assembled view of the first embodiment of the new and improved metering system for hot melt adhesive or other thermoplastic materials, for achieving variable output volumes of thereof, and as disclosed within FIG. 1, wherein the same effectively illustrates the use of such a metering system in connection with the discharge or dispensing of the hot melt adhesive or other thermoplastic material onto a substrate or product passing beneath the metering system along a substrate or product processing line during a hot melt adhesive or other thermoplastic material application or dispensing operation or cycle.
Figure 3:
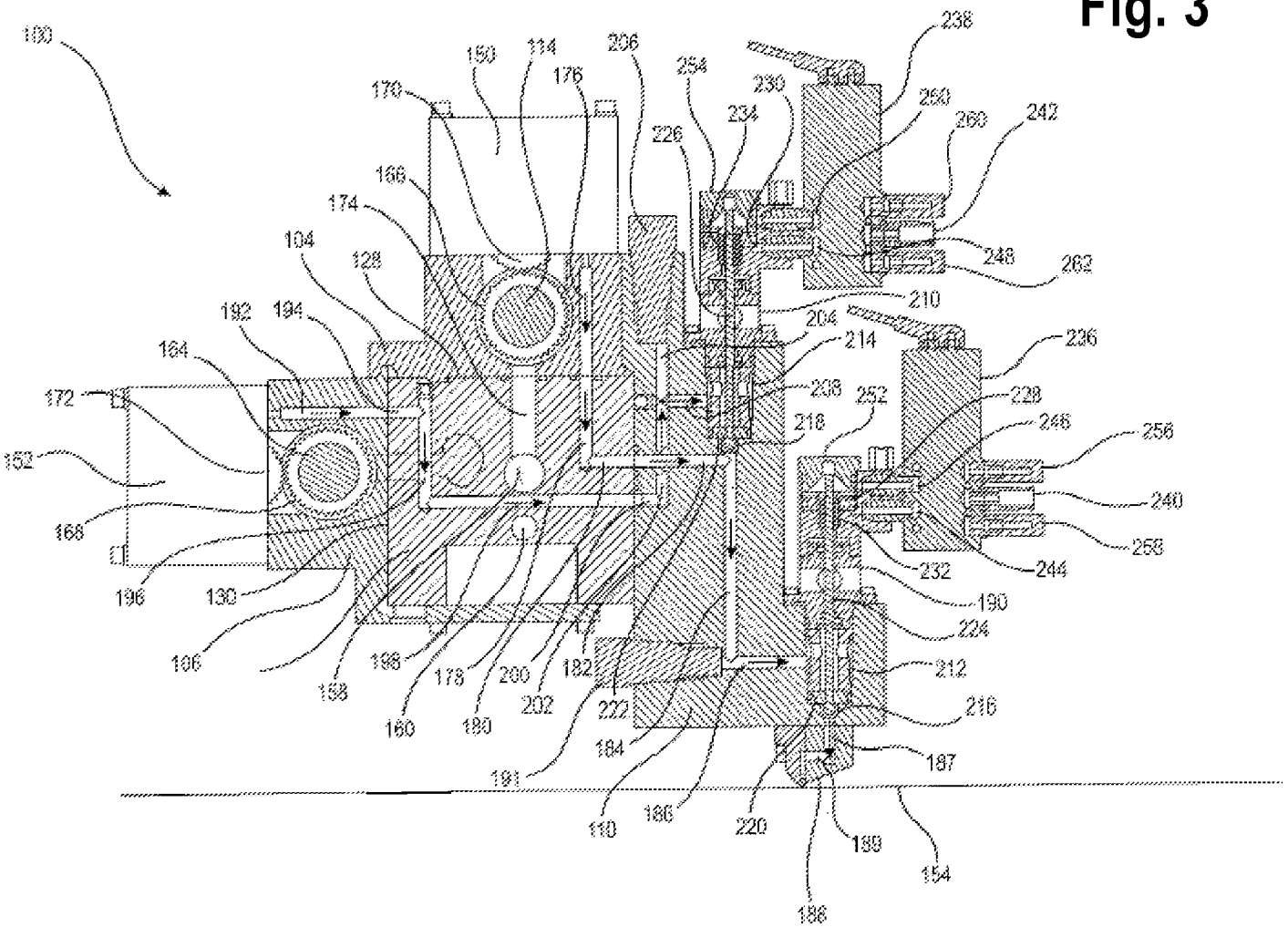
FIG. 3 is a cross-sectional view of the first embodiment of the new and improved metering system of the pre-sent invention, for dispensing variable volumes of hot melt adhesive or other thermoplastic material, as disclosed within FIG. 2 and as taken along the lines 3-3 of FIG. 2.

Referring now to the drawings, and more particularly to FIGS. 1-3 thereof, there is illustrated a first embodiment of a new and improved metering system which has been constructed in accordance with the principles and teachings of the present invention and which is generally indicated by the reference character 100. More particularly, the new and improved metering system 100 of the present invention is to be used for dispensing variable volumes of hot melt adhesive or other thermoplastic materials onto an underlying substrate or product as the substrate or product passes beneath the output devices or applicators along a product processing line during a hot melt adhesive or other thermoplastic material application or dispensing operation or cycle as can be readily appreciated from FIG. 2. Briefly, as can best be appreciated from FIG. 1, the new and improved metering sys-tem 100 of the present invention is seen to comprise a filter block 102 for filtering the incoming supply of hot melt adhesive or other thermoplastic material, a first gear pump assembly 104 comprising, for example, four rotary, gear-type metering pumps for outputting precisely metered amounts of the hot melt adhesive or other thermoplastic material, a second gear pump assembly 106 also comprising, for example, four rotary, gear-type metering pumps for outputting precisely metered amounts of the hot melt adhesive or other thermoplastic material, an adhesive manifold 108 for conducting the hot melt adhesive or other thermoplastic material, outputted by means of the first and second gear pump assemblies 104,106, to a suitable output device or applicator assembly 110, and a motor drive assembly 112 operatively connected to the adhesive manifold 108 for driving gear members, not shown, disposed within the adhesive manifold 108, which, in turn, drive the various gear members of the first and second gear pump assemblies 104 and 106 as will be more specifically described hereinafter. It is of course to be appreciated that the particular number of gear pumps comprising each one of the first and second gear pump assemblies 104 and 106 can vary as required or desired.

More particularly, and with reference continuing to be made to FIG. 1, it is to be appreciated that the output drive shaft, not shown, of the motor drive assembly 112 is adapted to be operatively connected to the drive shaft 114 of the first gear pump assembly 104 upon which the main drive gear 116 is fixedly mounted. In this manner, as the output drive shaft, not shown, of the motor drive assembly 112 is rotated, for example, in the clockwise (CW) direction, the drive shaft 114, and the main drive gear 116, of the first gear pump assembly 104 will likewise be rotated in the clock-wise (CW) direction as indicated by means of the arrow A. The external periphery of the main drive gear 116 of the first gear pump assembly 104 is provided with a predetermined number of gear teeth 118, and it is seen that the adhesive manifold 108 is provided with an idler gear 120, mounted upon rotary shaft 121, while the second gear pump assembly 106 is provided with a driven gear 122, the external peripheries of the idler gear 120 and the driven gear 122 likewise being provided with a predetermined number of gear teeth 124,126. Accordingly, as can best be appreciated from FIGS. 2 and 3, when the first gear pump assembly 104 is fixedly, but removably, mounted atop the upper surface portion 128 of the adhesive manifold 108, and when the second gear pump assembly 106 is fixedly, but removably, mounted upon the left side wall portion 130 of the adhesive manifold 108, the drive and driven gears 116,122 of the first and second gear pump assemblies 104,106 will be meshingly engaged with the idler gear 120 of the adhesive manifold 108 such that the clockwise (CW) rotation of the drive gear 116 of the first gear pump assembly 104 will effectively result in the counterclockwise (CCW) rotation of the idler gear 120 upon the adhesive manifold 108 and, in turn, the clockwise (CW) rotation of the driven gear 122 of the second gear pump assembly 106, as respectively de-noted by means of the arrows B,C, whereby the first and second gear pump assemblies 104,106 can pump hot melt adhesive or other thermoplastic material.

It is to be further appreciated that as a result of the independent and removable mounting of the first and second gear pump assemblies 104,106 upon the adhesive manifold 108, each one of the gear pump assemblies 104, 106 may be independently removed from the adhesive manifold 108 with respect to the other one of the gear pump assemblies 104,106 for the purposes of repair, maintenance, or to replace a particular one of the gear pump assembly 104,106 with a different gear pump assembly having, for example, a different volumetric output rating. Still further, it is also to be appreciated that as a result of the main drive gear 116 of the first gear pump assembly 104 having a predetermined number of external gear teeth 118, and, in a similar manner, as a result of the idler gear 120 of the adhesive manifold 108 and the driven gear 122 of the second gear pump assembly 106 also having a predetermined number of external gear teeth 124,126, a predetermined drive ratio is effectively established between the drive teeth 118 of the drive gear 116 and the teeth 124,126 of the idler and driven gears 120,122 such that the gear pump assemblies 104,106 have predetermined volumetric output ratings. However, it is to be additionally appreciated that the particular volumetric output rating of a particular one of the gear pump assemblies 104,106 may be changed or altered by providing one or both of the gear pump assemblies 104,106 with a different drive and driven gear 116,122 having a different number of gear teeth 118,126, which would then, in effect, change or alter the drive gear ratio effectively defined between that particular drive gear 116 and the driven gear 122, of the first or second gear pump assembly 104,106, as well as with respect to the idler gear 120 of the adhesive manifold 108. Depending upon whether a larger or smaller drive gear 116 was mounted upon the first gear pump assembly 104, or whether a larger or smaller driven gear 122 was mounted upon the second gear pump assembly 106, the angular and linear disposition of the idler gear 120 upon the adhesive manifold 108 may be altered by means of a slotted arm or bracket 123.

It is lastly noted that, with respect to the structure of the various components disclosed within FIG. 1, the filter block 102 is adapted to be mounted upon the end of the adhesive manifold 108 opposite the end at which the idler gear 120 is located. In order to accommodate the mounting of the filter block 102 upon such opposite end of the adhesive manifold 108, the adhesive manifold 108 is provided with an integral mounting block 132, and it is seen that a pair of apertures 134,136 are formed within an upper flanged portion 138 of the mounting block 132 for accepting or accommodating suitable mounting bolts, not shown. In a similar manner, the side wall portion or face 140 of the filter block 102 is likewise provided with a pair of apertures 142,144 for accepting or accommodating the mounting bolts, not shown. In addition, the side wall portion or face 140 of the filter block 102 is also provided with a first substantially pear-shaped outlet passageway 146 for supplying hot melt adhesive or other thermoplastic material from a supply of hot melt adhesive or other thermoplastic material, not shown, toward and into the adhesive manifold 108, and a second substantially pear-shaped inlet passageway 148 for permitting recirculated hot melt adhesive or other thermoplastic material to be con-ducted back from the adhesive manifold 108 and into the filter block 102, whereby the recirculated hot melt adhesive or other thermoplastic material can once again be conducted outwardly from the filter block 102 through means of the outlet supply passageway 146.

As was noted hereinbefore, each one of the pair of gear pump assemblies 104,106 respectively comprises a predetermined number of gear pumps 150,152. In the illustrated embodiment, the number of gear, pumps 150,152 comprising each one of the gear pump assemblies 104,106 is four, however, this number can be more than four or less than four as may be desired or required in connection with a particular substrate or product processing line. With reference now being made to FIG. 3, the fluid flow paths from each one a particular one of the gear pumps 150,152 of the first and second gear pump assemblies 104,106, through the adhesive manifold 108, and through the output device or applicator 110, so as to be discharged or outputted onto the substrate or product 154 being conveyed beneath the output device or applicator 110 along a product processing line 156, schematically illustrated within FIG. 2, will now be discussed. More particularly, with reference being made to FIG. 3, the adhesive manifold 108 is illustrated as having the first gear pump assembly 104, comprising one of its gear pumps 150, fixedly but removably mounted upon the upper surface portion 128 thereof, while second gear pump assembly 106, comprising one of its gear pumps 152, is fixedly but removably mounted upon the side wall portion 130 thereof. The adhesive manifold 108 is pro-vided with an axially extending fluid supply passageway 158 which is fluidically connected to the hot melt adhesive or other thermoplastic material supply outlet passageway 146 defined within the filter block 102, and is also provided with an axially extending fluid return or recirculation passageway 160 which is fluidically connected to the hot melt adhesive or other thermoplastic material inlet passageway 148 defined within the filter block 102.

It will be further appreciated from FIG. 1 that the drive gear 116 and the driven gear 122, respectively associated with the gear pump assemblies 102,104 and respectively driven by means of the drive motor assembly 112 and the enmeshed engagement with the idler gear 120 disposed upon the rotary shaft 121 of the adhesive manifold 108, are respectively mounted upon their rotary shafts 114,164 which are illustrated within both FIGS. 1 and 3. The shafts 114,164 have, in turn, drive gears 166,168 fixedly mounted thereon and disposed internally within the adhesive manifold 108, and the drive gears 166,168 are, in turn, enmeshed with gear pump driven gears 170,172 of a gear train assembly respectively disposed internally within each one of the gear pumps 150, 152. Accordingly, the supply of hot melt adhesive or other thermoplastic material is supplied from the supply outlet passageway 146 of the filter block 102, into the supply passageway 158 of the adhesive manifold 108, and into, for example, the annular space surrounding the outer periphery of the adhesive manifold drive gear 166 by means of a connecting fluid supply passageway 174 which extends upwardly within the adhesive manifold 108 and into the lower or bottom portion of the gear pump assembly 104. A similar connecting fluid supply passageway, not shown, is of course provided internally with-in the adhesive manifold 108 and into the right end portion of the gear pump assembly 106, as viewed in FIG. 3, so as to introduce hot melt adhesive or other thermoplastic material into the annular space surrounding the outer periphery of the adhesive manifold drive gear 168.

The fluid output of the gear train, internally disposed within the gear pump 150 and including the gear pump driven gear 170, is conducted outwardly from the gear pump 150 by means of a first vertically oriented output supply passageway 176, which extends downwardly through the gear pump assembly 104, and a second vertically oriented output supply passageway 178 which is fluidically connected to the downstream end of the first vertically oriented output supply passageway 176 and which is defined within the adhesive manifold 108. The downstream end of the second vertically oriented output supply passageway 178 is, in turn, fluidically connected to the upstream end of a third horizontally oriented output supply passageway 180 which is defined within the adhesive manifold 108, and the downstream end of the third horizontally oriented output supply passageway 180 is, in turn, fluidically connected to the upstream end of a fourth horizontally oriented output supply passageway 182 which is de-fined within the output device or applicator 110. A fifth vertically oriented output supply passageway 184 has its upstream end portion fluidically connected to the downstream end portion of the fourth horizontally oriented output supply passageway 182, and the downstream end portion of the fifth vertically oriented output supply passageway 184 is fluidically connected to the upstream end portion of a sixth horizontally oriented output supply passageway 186 which is also defined within the output device or applicator 110.

The down-stream end portion of the sixth horizontally oriented output supply passageway 186 is fluidically connected to a dispensing nozzle member 188, disposed upon the underside portion of the output device or applicator 110, through the intermediary of a first electrically controlled, solenoid-actuated control valve assembly 190, the detailed structure of which will be provided shortly hereinafter. The valve-controlled output of the electrically controlled, solenoid-actuated control valve assembly 190 is actually fluidically connected by means of a seventh vertically oriented output supply passageway 187 and an eighth horizontally oriented output supply passageway 189 which actually leads to the output port of the dispensing nozzle member 188. Lastly, it is seen that the upstream end of the sixth horizontally oriented output supply passage-way 186 is also fluidically connected to a first pressure relief valve assembly 191 so as to effectively define a return flow of the hot melt adhesive or other thermoplastic material in a direction which is opposite that of the supply flow of the hot melt adhesive or other thermoplastic material in the direction leading toward the electrically controlled solenoid-actuated control valve assembly 190 and the dispensing nozzle member 188, as will be described more particularly hereinafter.

In a similar manner, it is likewise to be appreciated that the fluid output of the gear train, internally disposed within the gear pump 152 and including the gear pump driven gear 172, is conducted outwardly from the gear pump 152 by means of a first horizontally oriented output supply passageway 192, which extends horizontally through the gear pump assembly 106, and a second horizontally oriented output supply passageway 194 which is fluidically connected to the downstream end of the first horizontally oriented output sup-ply passageway 192 and which is defined within the adhesive manifold 108. The downstream end of the second horizontally oriented output supply passageway 194 is, in turn, fluidically connected to the upstream end of a third vertically oriented output supply passageway 196 which is also defined within the adhesive manifold 108, and the downstream end of the third vertically oriented output supply passageway 196 is, in turn, fluidically connected to the upstream end of a fourth horizontally oriented output supply passageway 198 defined with-in the adhesive manifold 108. A fifth horizontally oriented output supply passageway 200, defined within the upper left central portion of the output device or applicator 110, has its upstream end portion fluidically connected to the down-stream end portion of the fourth horizontally oriented output supply passageway 198, and a sixth vertically oriented output supply passageway 202 has its upstream end portion fluidically connected to the downstream end portion of the fifth horizontally oriented output supply passageway 200. A first intermediate section of the sixth vertically oriented output supply passageway 202 is seen to effectively bypass, or be routed around, an intermediate section of the fourth horizontally oriented output supply passageway 182 defined within the output device or applicator 110, while a second intermediate section of the sixth vertically oriented output supply passageway 202 splits into a seventh vertically oriented return passageway 204, which is fluidically connected to a second pressure relief valve assembly 206, and an eighth horizontally oriented output supply passageway 208 which is adapted to be fluidically connected to the fifth vertically oriented output supply passageway 184, defined within the output device or applicator 110, by means of a second electrically controlled solenoid-actuated control valve assembly 210, the description of which will be provided shortly hereinafter. In this manner, the output supply of the hot melt adhesive or other thermoplastic material from pump 152 can likewise flow from the gear pump 152 to the dispensing nozzle member 188 disposed upon the underside portion of the output device or applicator 110.

Lastly, as has been noted hereinbefore, a description of the electrically controlled, solenoid-actuated control valve assemblies 190,210 will now be briefly described. The output device or applicator 110 is provided with two bores 212,214 within which the valve mechanisms, comprising ball valve members 216,218, are adapted to be disposed. The ball valve members 216,218 are adapted to engage underside portions of valve seat members 220,222 when the ball valve members 216,218 are disposed at their CLOSED positions, and it is further seen that the ball valve members 216,218 are fixedly mounted upon the lower end portions of vertically oriented valve stems 224,226. The upper end portions of the valve stems 224, 226 are fixedly mounted within piston members 228,230, and the piston members 228,230 are normally biased or assisted toward their raised or uppermost positions by means of coil springs 232,234. The electrically controlled, solenoid-actuated control valve assemblies 190,210 further comprise solenoid actuators 236,238 and control air in-let ports 240,242. Each one of the control air inlet ports 240,242 are fluidically connected to a pair of control air outlet ports 244,246 and 248,250 by means of fluid passageways disposed internally within the solenoid actuators 236, 238 but not shown for clarity purposes. The control air outlet ports 244, 246 and 248,250 fluidically connect each of the solenoid actuators 236,238 to the piston housings 252,254 of the valve assemblies 190,210, respectively, and it is to be understood or appreciated that the solenoid actuators 236,238 comprise suitable valve mechanisms disposed internally thereof, but not shown for clarity purposes, which will respectively control the flow of the incoming control air from control air inlet ports 240,242 to one of the control air outlet ports 244,246 and 248,250.

In this manner, the control air can, in effect, act upon the top surface portion or the undersurface portion of each one of the piston members 228,230 and thereby control the vertical disposition of the piston members 228,230 that, in turn, will control the disposition of the ball valve members 216,218 with respect to their valve seats 220,222. Accordingly, the ball valve members 216,218 will alternatively define CLOSED or OPEN states which will respectively prevent the flow of the hot melt adhesive or other thermoplastic material toward the dispensing nozzle member 188, or will permit the flow of the hot melt adhesive or other thermoplastic material toward the dispensing nozzle member 188. Lastly, a pair of mufflers 256,258 and 260,262 are operatively associated with each one of the control air inlets 240,242 so as to effectively muffle the sound of exhausted control air when the piston members 228,230 are moved between their upper and lower positions to as to respectively move the ball valve members 216,218 between their CLOSED or OPENED positions.

Figure 4:
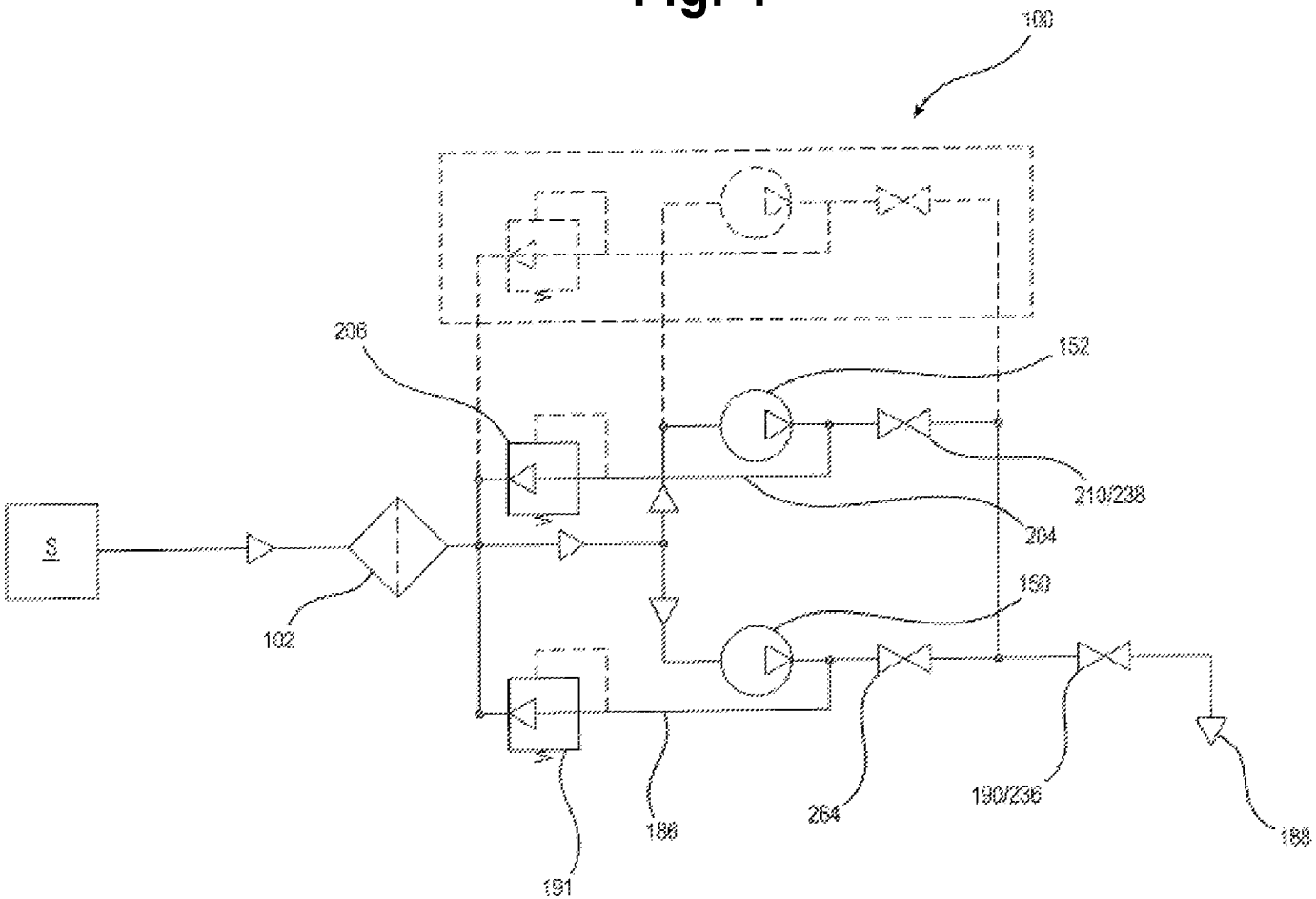
FIG. 4 is a schematic hydraulic circuit illustrating the various hydraulic connections of the various structural components of the first embodiment of the new and improved metering system of the present invention, and of the various hydraulic fluid flowpaths defined between such structural components, as disclosed, for example, within FIGS. 1-3.

Having described substantially all of the structural components of the first embodiment of the new and improved metering system 100 of the present invention, a brief description of the operation of the first embodiment of the new and improved metering system 100 of the present invention will now be described with reference being made primarily to FIG. 4 but also in connection with FIG. 2. With reference therefore being made to FIG. 4, it is seen that the hot melt adhesive or other thermoplastic material is supplied into the first embodiment of the new and improved metering system 100 from a suitable supply source S so as to pass through the filter block 102. From the filter block 102, the hot melt adhesive or other thermoplastic material is supplied to the first and second gear pumps 150,152, and it is seen that the output supply of the hot melt adhesive or other thermoplastic material from the gear pump 150 is conducted toward the dispensing nozzle member 188 along the various output supply passageways disclosed and described in connection with FIG. 3 and through means of the first electrically controlled solenoid-actuated control valve 190. In a similar manner, the output supply of the hot melt adhesive or other thermoplastic material from the gear pump 152 is conducted toward the dispensing nozzle member 188 along the various output supply passageways disclosed and described in connection with FIG. 3 and by means of the second electrically controlled solenoid-actuated control valve 210. It can therefore be appreciated that when, for example, the second electrically controlled solenoid-actuated control valve 210 is moved to its CLOSED position, the output supply of the hot melt adhesive or other thermoplastic material from gear pump 152 will effectively be blocked and shuttled into flowpath 204 so as to be conducted out through relief valve 206, and the return or recirculation path 160 disclosed within FIG. 3, and back to the filter block 102. Similarly, when, for example, the first electrically controlled solenoid-actuated control valve 190 is moved to its CLOSED position, the output supply of the hot melt adhesive or other thermoplastic material from both of the gear pumps 150,152 will effectively be blocked and shuttled into flowpaths 186,204 so as to be conducted out through relief valves 191,206, and the return or recirculation path 160 disclosed within FIG. 3, back to the filter block 102.

Accordingly, it can be further appreciated that by means of the new and improved metering system 100, as constructed in accordance with the principles and teachings of the present invention, the output or dispensing from the dispensing nozzle member 188, for dispensing, discharge, or deposition of the hot melt adhesive or other thermoplastic material onto the substrate or product 154 as illustrated with-in FIGS. 2 and 3, can effectively achieve THREE operational states. The FIRST state is the OFF state when, for example, as has just been described, the first electrically controlled solenoid-actuated control valve 190 has been moved to its CLOSED position whereby the output of the hot melt adhesive or other thermoplastic material from the dispensing nozzle member 188 is zero, all of the hot melt adhesive or other thermoplastic material having been blocked and shuttled back to the filter block 102 through means of the relief valves 191,206 and the return or recirculation paths. The SECOND state effectively comprises a FIRST PARTIAL VOLUME state wherein the first electrically controlled solenoid-actuated control valve 190 has been moved to its OPENED position but the second electrically controlled solenoid-actuated control valve 210 has been moved to its CLOSED position. Accordingly, only the output volume of the hot melt adhesive or other thermoplastic material outputted by means of the first gear pump 150 is being conducted to the dispensing nozzle member 188 for deposition onto the underlying substrate or product 154. The THIRD state effectively comprises a FULL or COMBINED VOLUME state wherein both the first and second electrically controlled solenoid-actuated control valves 190,210 have been moved to their OPENED positions such that the output volumes of the hot melt adhesive or other thermoplastic material, outputted by means of both of the gear pumps 150,152, are being conducted to the dispensing nozzle member 188 for deposition onto the underlying substrate or product 154.

Continuing still further, a third electrically controlled solenoid-actuated control valve 264 can effectively be mounted upon the output device or applicator 110 so as to be disposed at a position interposed between the output of the gear pump 150 and the first electrically controlled solenoid-actuated control valve 190 as is schematically illustrated within FIG. 4. In this manner, the new and improved metering system 100 of the present invention is rendered more flexible and utilitarian in view of the fact that a FOURTH operational state is effectively imparted to the system 100 wherein the FOURTH operational state effectively comprises a SECOND PARTIAL VOLUME state.

In accordance with this operational state, the first electrically controlled solenoid-actuated control valve 190 has been moved to its OPENED position, but the third electrically controlled solenoid-actuated control valve 264 has been moved to its CLOSED position. Accordingly, only the output volume of the hot melt adhesive or other thermoplastic material outputted by means of the second gear pump 152 is being conducted to the dispensing nozzle member 188 for deposition onto the underlying substrate or product 154. Naturally, when it is again desired to achieve the THIRD FULL or COMBINED VOLUME operational state, it must be ensured that all three of the first, second, and third electrically controlled solenoid-actuated control valves 190, 210,264 have all been moved to their OPENED positions. Still yet further, while the description and drawings have only been directed toward the provision of two gear pump assemblies 104,106 respectively comprising the various gear pumps 150,152, additional gear pump assemblies, comprising additional gear pumps, can of course be implemented into the system 100, such additional gear pump assemblies, their associated gear pumps, electrically-controlled solenoid-actuated control valves, and relief valves being illustrated in phantom lines within FIG. 4.

With reference reverting back to FIG. 2, it is to be seen and appreciated that an additional operational condition can be achieved in accordance with the principles and teachings of the present invention by means of the metering system 100. It is to be recalled that each one of the gear pump assemblies 104,106 comprises, for example, four gear pumps 150,152 which are disposed in side-by-side fashion as disclosed within FIG. 1. For clarity purposes, and to illustrate the additional operational condition of the metering system 100 of the present invention, the four gear pumps of each gear pump assembly 104,106 have been designated as gear pumps 150-1,150-2,150-3,150-4,152-1,152-2,152-3,152-4. In addition, each one of the gear pumps 150-1,150-2,150-3,150-4,152-1, 152-2,152-3,152-4 has operatively associated therewith the first and second electrically controlled solenoid-actuated control valves which have therefore been accordingly designated as 236-1,236-2,236-3,236-4,238-1,238-2,238-3,238-4. If the system opts to have third electrically controlled solenoid-actuated control valves 264 incorporated therein, then such valves can also be respectively provided, although they have not been illustrated within FIG. 2. It is to be further appreciated that the side-by-side disposition of the first and second gear pumps 150-1,150-2,150-3,150-4,152-1, 152-2,152-3, 152-4 will lead to side-by-side deposits of the hot melt adhesive or other thermo-plastic material from suitably individual dispensing nozzle members, not shown in FIG. 2 but similar to the dispensing nozzle member 188 shown in FIG. 3, onto the underlying substrate or product 154 so as to effectively define side-by-side lanes or longitudinally extending strips 266,268,270,272 of the hot melt adhesive or other thermoplastic material upon the substrate 154.

Accordingly, it can be appreciated further that the overall width of the hot melt adhesive or other thermoplastic material deposited onto the underlying product or substrate can vary, that is, it can extend across all four lanes 266, 268,270,272, as at 274, or it can be relatively or effectively narrowed by only extending across the two central lanes 268,270, as at 276, depending upon whether or not the output to a particular one of the dispensing nozzle members 188 has been CLOSED or OPENED by control of, for example, the first electrically controlled solenoid-actuated control valves 236-1,236-2, 236-3,236-4 as has been previously described in connection with the various operational states of the metering system 100 of the present invention. Still further, it is also to be appreciated that the particular volume emitted from each one of the dispensing nozzle members 188 and deposited onto the substrate or product 154 within a particular one of the lanes or strips 266,268,270,272 of hot melt adhesive or other thermoplastic material can likewise be varied from one of the PARTIAL VOLUME states to the COMBINED FULL VOLUME state as has also been previously described. Finally, it can readily be appreciated that other modes of operation are similarly capable of being achieved in connection with rotary gear pumps 150-1,150-2,150-3,150-4,152-1,152-2,152-3,152-4 as controlled by means of electrically controlled, solenoid-actuated control valve assemblies 236-1,236-2,236-3,236-4, 238-1,238-2,238-3,238-4 or other combinations of the rotary gear pumps 150-1,150-2,150-3,150-4,152-1,152-2,152-3, 152-4 and the electrically controlled, solenoid-actuated control valve assemblies 236-1,236-2,236-3,236-4,238-1238-2, 238-3,238-4, so as to, for example, deposit the hot melt adhesive or other thermoplastic material only within certain ones of the lanes 266,268,270,272 and at predetermined times.

Figure 5:
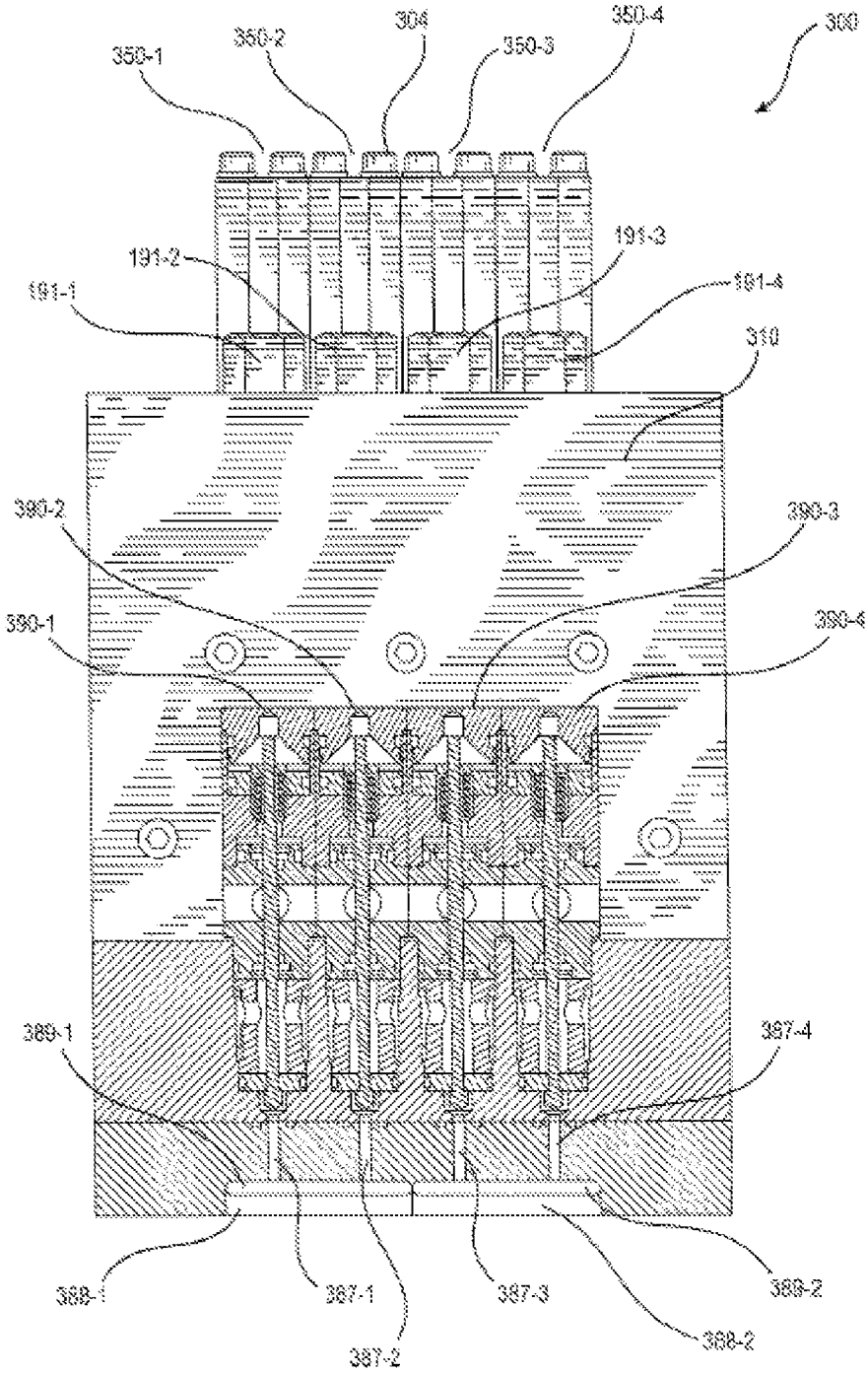
FIG. 5 is a schematic hydraulic circuit illustrating the various hydraulic connections of the various structural components, and of the various hydraulic fluid flowpaths defined therebetween, comprising a second alternative embodiment metering system of the present invention.

With reference now being lastly made to FIG. 5, there is illustrated a second embodiment of a new and improved metering system which has also been constructed in accordance with the principles and teachings of the present invention and which is generally indicated by the reference character 300. It is to be initially noted that the various components of the second embodiment of the new and improved metering system 300, as disclosed within FIG. 5, which correspond to the various components of the first embodiment of the new and improved metering system 100, as illustrated, for example, within FIGS. 2 and 3, will be designated by corresponding reference characters except that they will be within the 300 series. In addition, a detailed description of the second embodiment of the new and improved metering system 300 will be omitted for the purposes of brevity, it being assumed that the similarities and parallels of the first and second embodiments of the new and improved metering systems 100,300 will be readily apparent, and therefore, the description will be focused on the differences between the second embodiment of the new and improved metering system 300 with respect to the new and improved metering system 100. More particularly, the major difference between the first and second embodiments of the new and improved metering systems 100,300 of the pre-sent invention resides in the fact that in accordance with the principles and teachings of the first embodiment of the new and improved metering system 100, the fluid flows of the hot melt adhesive or other thermoplastic material, toward each one of the dispensing nozzle members 188, was being conducted from individual pumps 150,152 disposed within the two separate sets of pumps comprising the two different pump assemblies 104,106. To the contrary, but in a similar manner, in accordance with the principles and teachings of the second embodiment of the new and improved metering system 300, the fluid flows of the hot melt adhesive or other thermoplastic material, toward each one of the dispensing nozzle members 388-1,388-2, is being conducted from two separate or individual pumps 350-1,350-2,350-3,350-4 disposed within the same set of pumps comprising, for example, the single pump assembly 304.

Accordingly, with reference being made to FIG. 5, the individual pumps of the pump assembly 304 are designated as 350-1,350-2,350-3,350-4, and the pressure relief valves operatively associated with the individual pumps 350-1,350-2,350-3,350-4 of the pump assembly 304 are designated at 191-1,191-2,191-3,191-4. In a similar manner, the electrically controlled, solenoid-actuated control valve assemblies, operatively associated with the individual pumps 350-1,350-2, 350-3,350-4 and fluidically controlling the fluid outputs from such pumps 390-1,390-2,390-3,390-4 toward the dispensing nozzle members 388-1,388-2, are designated at 390-1,390-2, 390-3,390-4. Therefore, it can be appreciated, in a broad manner similar to that of the first embodiment of the new and improved metering system 100, when electrically controlled, solenoid-actuated control valve assemblies 390-1,390-2 are both closed, no fluid flow, comprising the hot melt adhesive or other thermoplastic material, from rotary gear pumps 350-1,350-2 is outputted to the dispensing nozzle member 388-1, and therefore, the hot melt adhesive or other thermoplastic material is recirculated back to the filter block, not shown in FIG. 5, by means of the pressure relief valves 191-1, 191-2. Accordingly, this phase of the operation of the metering system 300 obviously constitutes the FIRST or OFF OPERA-TIVE STATE. When the electrically controlled, solenoid-actuated control valve assembly 390-1 is open, but the electric-ally controlled, solenoid-actuated control valve assembly 390-2 is closed, then only the hot melt adhesive or other thermoplastic fluid output flow from pump 350-1 is conducted toward the dispensing nozzle member 388-1 for deposition onto the underlying substrate or product. This phase of the operation of the metering system 300 therefore constitutes the SECOND STATE or FIRST PARTIAL VOLUME OPERATIVE STATE.

Conversely, when the electrically controlled, solenoid-actuated control valve assembly 390-2 is open, but the electrically controlled, solenoid-actuated control valve assembly 390-1 is closed, then only the hot melt adhesive or other thermoplastic fluid output flow from pump 350-2 is conducted toward the dispensing nozzle member 388-1 for deposition onto the under-lying substrate or product. This phase of the operation of the metering system 300 therefore constitutes the THIRD STATE or SECOND PARTIAL VOLUME OPERATIVE STATE. It is seen that the output flows from the pumps 350-1, 350-2 are conducted along fluid passageways 387-1,387-2 into a common or balancing channel 389-1. Lastly, when both of the electrically controlled, solenoid-actuated control valve assembly 390-1,390-2 are open, the hot melt adhesive or other thermoplastic fluid outputs flow from both of the rotary gear pumps 350-1,350-2 and are conducted toward the dispensing nozzle member 388-1 for deposition onto the underlying substrate or product. This phase of the operation of the metering system 300 therefore constitutes the FOURTH or FULL VOL-UME OPERATIVE STATE. It can readily be appreciated that other modes of operation are similarly capable of being achieved in connection with rotary gear pumps 350-3,350-4 as controlled by means of electrically controlled, solenoid-actuated control valve assemblies 390-3,390-4, or other combinations of rotary gear pumps 350-1,350-2,350-3,350-4, and electrically controlled, solenoid actuated control valve assembly 390-1, 390-2,390-3,390-4.

Thus, it may be seen that in accordance with the Principles and teachings of the present invention, there has been provided a new and improved hot melt adhesive or other thermoplastic material dispensing system which comprises the utilization of two separate and independent rotary, gear-type metering pumps, or two separate and independent sets of rotary, gear-type metering pumps, which are adapted to output or discharge precisely metered amounts of hot melt adhesive or other thermoplastic material. In particular, the precisely metered amounts of the hot melt adhesive or other thermoplastic material discharged from the two separate and independent rotary gear pumps, or from the two separate and independent sets of rotary gear pumps, are able to in fact be independently discharged or outputted through suitable output devices or applicators onto a particular substrate so as to result in different discharged or outputted volumes of the hot melt adhesive material or other thermoplastic material onto the substrate in accordance with predeterminedly required or desired patterns, or at predeterminedly required or desired locations. Still further, the precisely metered amounts of the hot melt adhesive or other thermo-plastic material from the two separate and independent rotary gear pumps, or from the two separate and independent sets of rotary gear pumps, may also have their volumetric outputs effectively combined. In this manner, the discharged or outputted volumes of the hot melt adhesive or other thermoplastic material onto the substrate may effectively be, for example, twice the discharged or outputted volumes of the hot melt adhesive or other thermoplastic material discharged or outputted onto the substrate from only one of the two separate and independent rotary gear pumps, or from only one of the two separate and independent sets of rotary gear pumps.

The present system is used to carry out a method of making an article having a substrate and a material applied thereto. In such a method, a metered fluid dispensing system 100 is provided. The system has a supply of fluid to be dispensed, an output device having at least one dispensing nozzle and at least two pumps for pumping fluid from the supply to the at least one dispensing nozzle.

The at least two pumps are in close proximity to the at least one dispensing nozzle. Output supply passageways interconnect the at least two pumps and the at least one dispensing nozzle, and flow control elements selectively control the passage of the fluid from the at least two pumps to the at least one dispensing nozzle.

The dispensing system is configured for at least three dispensing states, a first state in which fluid outputs from both of the at least two pumps is prevented from reaching the at least one dispensing nozzle, a second state in which fluid output from one of the at least two pumps is permitted to from reach the at least one dispensing nozzle and fluid output from the other of the at least two pumps is prevented from reaching the at least one dispensing nozzle, and a third state in which fluid outputs from both of the at least two pumps is permitted to reach the at least one dispensing nozzle.

The method further includes conveying the substrate past the fluid dispensing system in a machine direction and applying the fluid to the substrate in a plurality of segments. Each segment has a volume per unit length and is applied in a length in the machine direction to define a pattern. The pattern includes at least some areas in which the fluid is present at a first volume as applied as output from one of the at least two pumps and at least some areas in which fluid is present at a second volume that is greater than the first volume, as applied as output from both of the at least two pumps.

Figure 6A:
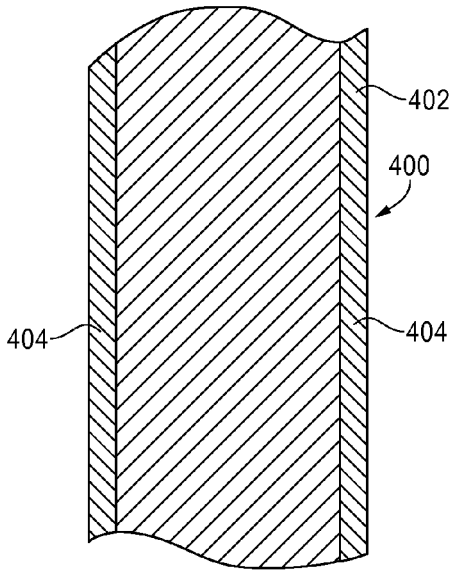
FIGS. 6A-6C are illustrations of various fluid application material patterns produced using methods of the present invention and the present metering system, embodying the principles of the present invention.
Figure 6B:
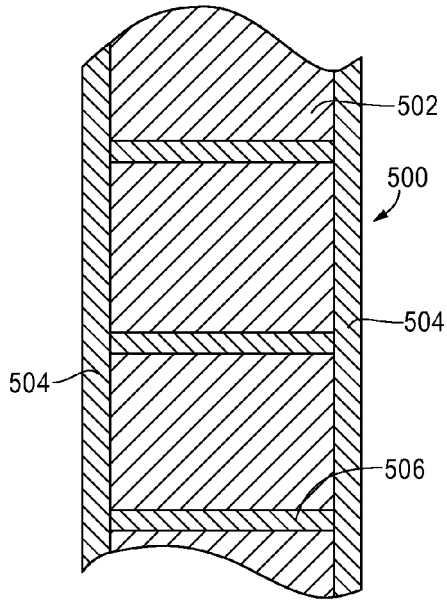
Figure 6C:
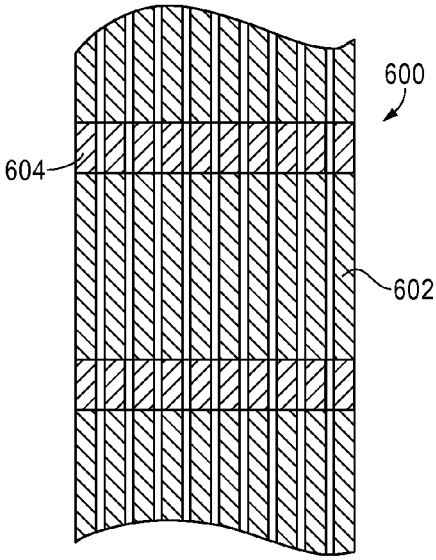

Exemplary patterns are illustrated in FIGS. 6A-6C. In FIG. 6A, a window box pattern 400 is illustrated in which the first volume of fluid can be present in the area indicated at 402 and the second volume of fluid can be present in the area indicated at 404. As will be appreciated by those skilled in the art, the area indicated at 404 can be formed with the volumes of both areas 402 and 404, or, as illustrated the volume of 404 only.

In FIG. 6B, a ladder pattern 500 is illustrated. In this pattern, the first volume of fluid can be present in the are indicated at 502 and the second volume of fluid can be present in the area indicated at 504. It will be understood that the area indicated at 506 can be formed with the first volume of fluid, the second volume of fluid, or the first and second volumes of fluid. Alternately, it will also be appreciated that any of the areas can also be devoid of fluid.

In FIG. 6C, a striped pattern 600 is illustrated. In this pattern, with the first volume of fluid, or the second volume of fluid, or the first and second volumes of fluid are applied is an elongated manner in the machine direction as illustrated at 602. In the areas indicated at 604, any of the volumes not present in the areas at 602 can be applied, or, conversely, any of the volumes present at 602 can be held back or prevented from being applied, as desired.

As such, it will be appreciated that at least in some areas on the substrate no fluid may be present. It will also be appreciated that the fluid in either or both of the first and second volumes can be non-contiguous in the machine direction or in the transverse direction, or in both the machine direction and the transverse direction.

The fluids can be applied in a variety of processes, including in a contact (e.g., slot-coated) application or a non-contact application (e.g., spray coating) application.

In a preferred method, the metered fluid dispensing system includes at least two dispensing nozzles and at least two pumps associated with the first and second volumes of fluid. In such method, the passageways are disposed within a manifold, preferably a non-flexing manifold that does not allow for expansion.

In carrying out the method the volume of the fluid can be increased per unit length for at least a predetermined length of a segment in the machine direction, and can be increased per unit length for at least a predetermined length of a plurality of segments in a transverse direction.

The method can also include the step of applying a member, such as a flexible member (e.g., a woven, non-woven or other textile-like member, a resilient member or the like) over the substrate and the fluid. And, an article can formed using the present method.

Obviously, many variations and modifications of the present invention are possible in light of the above teachings. It is therefore to be understood that within the scope of the appended claims, the present invention may be practiced otherwise than as specifically described herein.

What is claimed is:

1. A method of making an article having a substrate and a material applied thereto, comprising:

providing a metered fluid dispensing system having a common supply of fluid to be dispensed, an output device having at least one dispensing nozzle, at least two pumps for pumping fluid from the common supply to the at least one dispensing nozzle, output supply passageways interconnecting the at least two pumps and the at least one dispensing nozzle, and flow control elements to selectively control the passage of the fluid from the at least two pumps to the at least one dispensing nozzle, the dispensing system configured to dispense a varied volume of fluid through at least three dispensing states, a first state in which fluid outputs from both of the at least two pumps is prevented from reaching the at least one dispensing nozzle, a second state in which fluid output from one of the at least two pumps is permitted to reach the at least one dispensing nozzle and fluid output from the other of the at least two pumps is prevented from reaching the at least one dispensing nozzle, and a third state in which fluid outputs from both of the at least two pumps is permitted to reach the at least one dispensing nozzle;

conveying the substrate past the fluid dispensing system in a machine direction; and applying the fluid to the substrate in a plurality of segments, each segment having a volume per unit length and applied in a length in the machine direction to define a pattern and wherein the pattern includes at least some areas in which the fluid is present at a first volume as applied as output from one of the at least two pumps and at least some areas in which fluid is present at a second volume that is greater than the first volume, as applied as output from both of the at least two pumps.

2. The method in accordance with claim 1 including at least some areas on the substrate in which no fluid is present.

3. The method in accordance with claim 1 wherein the fluid is non-contiguous in the machine direction.

4. The method in accordance with claim 1 wherein the fluid is non-contiguous in the transverse direction.

5. The method in accordance with claim 1 wherein the fluid is non-contiguous in both the machine direction and the transverse direction.

6. The method in accordance with claim 1 wherein the fluid is applied in a contact application.

7. The method in accordance with claim 6 wherein the contact application is a slot-coated application.

8. The method in accordance with claim 1 wherein the fluid is applied in a non-contact application.

9. The method in accordance with claim 8 wherein the non-contact application is a spray coating application.

10. The method in accordance with claim 1 wherein the pattern includes at least one of a window frame, a ladder and a stepped pattern.

11. The method in accordance with claim 1 wherein the volume of the fluid is increased per unit length for at least a predetermined length of a segment in the machine direction.

12. The method in accordance with claim 1 wherein the volume of the fluid is increased per unit length for at least a predetermined length of a plurality of segments in a transverse direction.

13. The method in accordance with claim 1 wherein the metered fluid dispensing system includes at least two dispensing nozzles and at least two pumps associated with the first and second volumes of fluid.

14. The method in accordance with claim 1 wherein the passageways are disposed within a manifold.

15. The method in accordance with claim 1 including the step of applying a member over the substrate and the fluid.

* * * * *